US005598928A

United States Patent [19]

Hossard et al.

[11] Patent Number: 5,598,928

[45] Date of Patent: Feb. 4, 1997

[54] SLIDING SLEEVE DEVICE FOR JOINING PROPELLANT CHARGE CONTAINERS AND CONTAINER HAVING SUCH A DEVICE

[75] Inventors: Michel Hossard, Bourges; Yves Cappy, Saint Denis de Palin, both of France

[73] Assignee: Giat Industries, Versailles, France

[21] Appl. No.: 448,369

[22] PCT Filed: Nov. 22, 1994

[86] PCT No.: PCT/FR94/01357

§ 371 Date: May 31, 1995

§ 102(e) Date: May 31, 1995

[30] Foreign Application Priority Data

Dec. 1, 1993 [FR] France ..... 93 14340

[51] Int. Cl.[6] ..... F42B 5/00

[52] U.S. Cl. ..... 206/509; 220/4.27; 102/282

[58] Field of Search ..... 220/23.4, 4.01, 220/4.03, 4.26, 4.27; 206/509; 102/282

[56] References Cited

U.S. PATENT DOCUMENTS

| | | | |
|---|---|---|---|
| 2,326,414 | 8/1943 | Thompson | 220/4.27 |
| 3,176,617 | 4/1965 | Brafford | 102/282 |
| 3,376,816 | 4/1968 | Foster et al. | 220/4.27 X |
| 3,395,642 | 8/1968 | Foster et al. | 220/4.27 X |
| 4,598,832 | 7/1986 | Alonso | 220/4.27 X |
| 5,090,323 | 2/1992 | Kallevig et al. | 102/282 |
| 5,212,342 | 5/1993 | Eches et al. . | |
| 5,422,129 | 6/1995 | Draddy | 220/4.26 X |

FOREIGN PATENT DOCUMENTS

| | | |
|---|---|---|
| 2620214 | 3/1989 | France . |
| 2672672 | 8/1992 | France . |
| 917193 | 1/1963 | United Kingdom . |
| 2136929 | 9/1984 | United Kingdom . |

*Primary Examiner*—Steven M. Pollard
*Attorney, Agent, or Firm*—Oliff & Berridge

[57] ABSTRACT

A device for joining a first container to a second container, in which a first face of the first container is alignable with a second face of the second container along a longitudinal axis, includes a first narrowed portion, a second narrowed portion and a sleeve. The first narrowed portion is disposed adjacent the first face of the first container. The second narrowed portion is disposed adjacent the second face of the second container. The sleeve is disposed around the first narrowed portion and is shaped to slide parallel to the longitudinal axis from a first position to a second position. The sleeve in the second position at least partially covers and threadedly engages a corresponding threaded portion of the second container. As a result, the device permits two containers to be joined securely yet disassembled quickly.

20 Claims, 5 Drawing Sheets

SLIDING SLEEVE DEVICE FOR JOINING PROPELLANT CHARGE CONTAINERS AND CONTAINER HAVING SUCH A DEVICE

The field of the present invention is that of containers capable of accommodating a propellant charge and more particularly that of containers used in the field of large calibre or tank artillery.

In order to adjust the range of the round, it is often necessary to modify the amount of powder used for firing a projectile.

Modular containers have already been defined that are substantially cylindrical and made of a combustible material. Their rigidity makes such containers more easy to use than traditional bags of powder.

In order to reduce the space taken up by ammunition inside armoured vehicles, it may also be necessary to subdivide each round into two separate parts, one carrying the main propellant charge and the other the projectile and possibly a secondary propellant charge (such ammunition is described for example in patent GB2136929).

In any event one may consider the problem of integrating several containers.

For example it may be valuable to speed up the loading process by introducing all the containers in a single operation, for example by means of an automatic loading system.

It is then essential to integrate the containers together in order to give a degree of rigidity to the assembly.

Moreover it may prove necessary to quickly remove the charge already inserted in the chamber of a gun, and this process is made longer and more difficult if the entire charge is divided into several parts.

Patent FR9101499 describes a device for connecting containers together which comprises, first, a sliding sleeve and, secondly, automatic means of coupling positioned on a front surface of the container.

Such a system is complex and costly to manufacture.

Moreover it may or may not be necessary to link the containers together, according to operational requirements. The means proposed by FR9101499 do not allow such a choice to be made, the axial connection in all cases being provided by the automatic couplings.

Finally, the means proposed by FR9101499 are awkward to use. Thus for the sleeve to be able to slide, the radial positioning of the two containers must be exact. In fact the means of coupling are active whatever the relative radial position of the two containers. Consequently it is difficult to position the two containers and then to integrate them together.

The purpose of the present invention is to provide a container that is not affected by such drawbacks.

The invention therefore proposes a container comprising simple and inexpensive means of integrating it with a second container at one of its front surfaces.

Such a container can be connected quickly and easily to another container according to the invention, separation of the containers being equally easy.

Hence the purpose of the invention is a container intended to be integrated with a second container at one of its front surfaces, and comprising a sleeve fitted so as to slide on a first narrowed portion or neck, the said sleeve capable of sliding so as partly to cover a second narrowed portion or neck made on the second container, characterised by the fact that the sleeve carries a thread tapped on a forward end, the said thread being intended to engage on a thread integral with the second container.

According to another characteristic of the invention, the first neck has an annular collar upon which bears a shoulder machined on a rear part of the sleeve so as to immobilise the containers axially when the sleeve covers the second neck of the second container.

With advantage, the container has an inner sleeve integral with the first neck and which carries the annular collar, an inner sleeve upon which the sleeve can slide.

The purpose of the invention is also a container intended to be integrated at one of its front surfaces with another container, the said container being characterised by the fact that it comprises a second neck which is threaded, intended to accommodate a tapped and sliding sleeve carried by the other container.

This container advantageously comprises a threaded ring integral with the second neck.

According to another characteristic of the invention, the container comprises means ensuring radial positioning with another container.

Thus the means of radial positioning may comprise a tubular extension intended to fit into a complementary circular slot in another container.

The means of radial positioning may comprise a circular slot intended to accommodate a complementary tubular extension carried by another container.

According to another embodiment of the invention, the means of radial positioning may comprise a recess with the section of a frustum of a cone in the centre of the front surface, the said recess being intended to accommodate a complementary projection carried by another container.

The means of radial positioning may also comprise a projection with the section of a frustum of a cone placed in the centre of the front surface, the said projection being intended to fit into a complementary recess on another container.

According to a variant of the invention, the container has a neck at each end, one of the necks being threaded and the other carrying a tapped sliding sleeve.

The different components—sleeve, ring or inner sleeve—will preferably be made of a plastics material such as high density polyethylene or polyamide.

The invention will be better understood from a reading of the description of specific embodiments, referring to the attached drawings on which:

Figure 1:
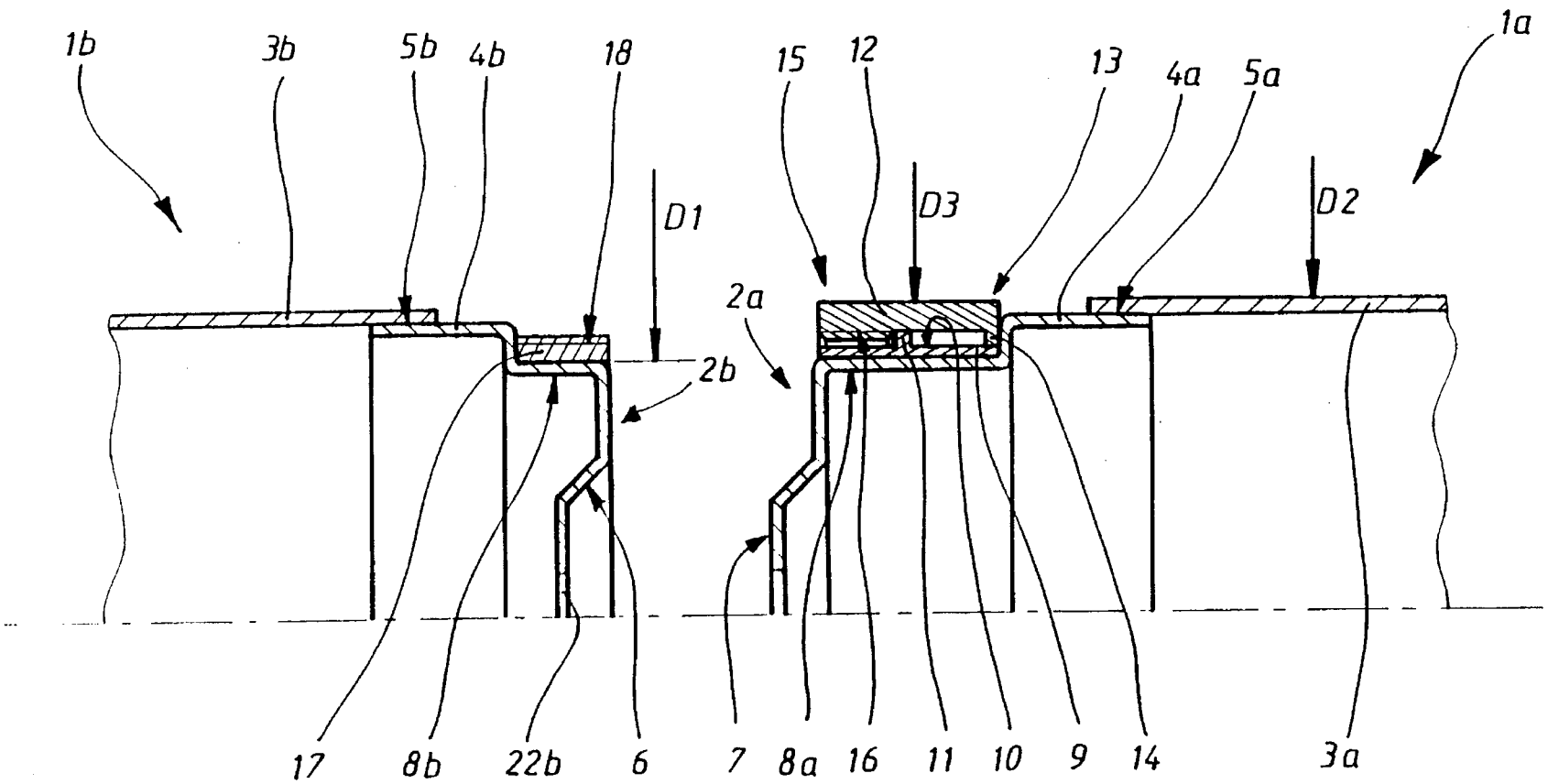
FIG. 1 is a partial cross-section of two containers according to a first embodiment of the invention, before they are integrated.

With reference to FIG. 1, a first container 1*a* is intended to be integrated with a second container 1*b* at its front surface 2*a*. The latter will then be in contact with the front surface 2*b* of the second container.

Each container consists of a cylindrical casing 3*a*, 3*b* made of a combustible material such as nitrocellulose, cardboard or a cardboard/nitrocellulose mixture.

The casings are closed by end plugs 4*a*, 4*b* which are also made of a combustible material. The plugs are attached to the casings by glueing at the cylindrical surfaces 5*a*, 5*b*.

The containers 1*a* and 1*b* are shown here only partially. They are intended to accommodate a propellant charge in granular or stick form (not shown).

Container 1b carries at its other end a projectile (not shown) which will be integrated with the casing 2 by a connecting sleeve (similar for example to the one described in patent FR8712484).

The container 1a carries at its other end a base (not shown) fitted with an ignition tube (see, for example, patent FR9101499 which shows the mounting of such a base on the casing).

The plug 4b has a recess 6 with the section of a frustum of a cone positioned in the centre of the front surface 2b.

The plug 4a has a projection 7 with the section of a frustum of a cone positioned in the centre of the front surface 2a.

The conical sections of the recess 6 and the projection 7 are complementary and are intended to fit into one another to enable relative radial positioning of the two containers before they are assembled together.

Axial openings 22a and 22b are made in the front surfaces 2a and 2b of the containers. These openings facilitate flame transmission from one container to the other during ignition of the propellant charge. They are closed off in a known manner by means of combustible sheets (not shown here).

The end plugs 4a and 4b each have a neck 8a, 8b the maximum diameter of which D1 is less than the outside diameter D2 of the container by about 10 mm.

The neck 8a of container 1a (hereunder denoted first neck) carries an inner sleeve 9 attached for example by glueing. This inner sleeve is made of a plastics material, for example high density polyethylene or polyamide.

The inner sleeve 9 carries an annular collar 11 on its outer cylindrical surface 10.

A sleeve 12 is fitted so that it can slide on the inner sleeve 9. The sleeve 12 is also made of a plastics material such as high density polyethylene or polyamide.

It comprises a shoulder 14 on a rear part 13. The sleeve also has a tapped thread 16 at its forward end 15.

The diameter of the tapping 16 is greater than the outside diameter of the inner sleeve 9, which allows the sleeve to slide on the inner sleeve. The shoulder 14 is intended to come up against the collar 11 so as to limit the axial displacement of the sleeve on the inner sleeve.

From the assembly point of view, the sleeve is placed on the inner sleeve before the latter is glued on the first neck 8a. By this means the sleeve 12 can no longer be separated from the container 1a, which avoids its being lost and simplifies logistics.

When it is positioned on the inner sleeve 9, the sleeve 12 has an outside diameter D3 which is less than or equal to that (D2) of the container. Thus the sleeve 12 does not interfere with the loading of the container into the chamber of a gun.

The container 1b carried on its neck 8b (hereunder denoted second neck) a ring 17 attached for example by glueing. This ring is also made of a plastics material for example high density polyethylene or polyamide.

The ring 17 carries a thread 18 which is intended to accommodate the tapping 16 on the sleeve 12.

Figure 2:
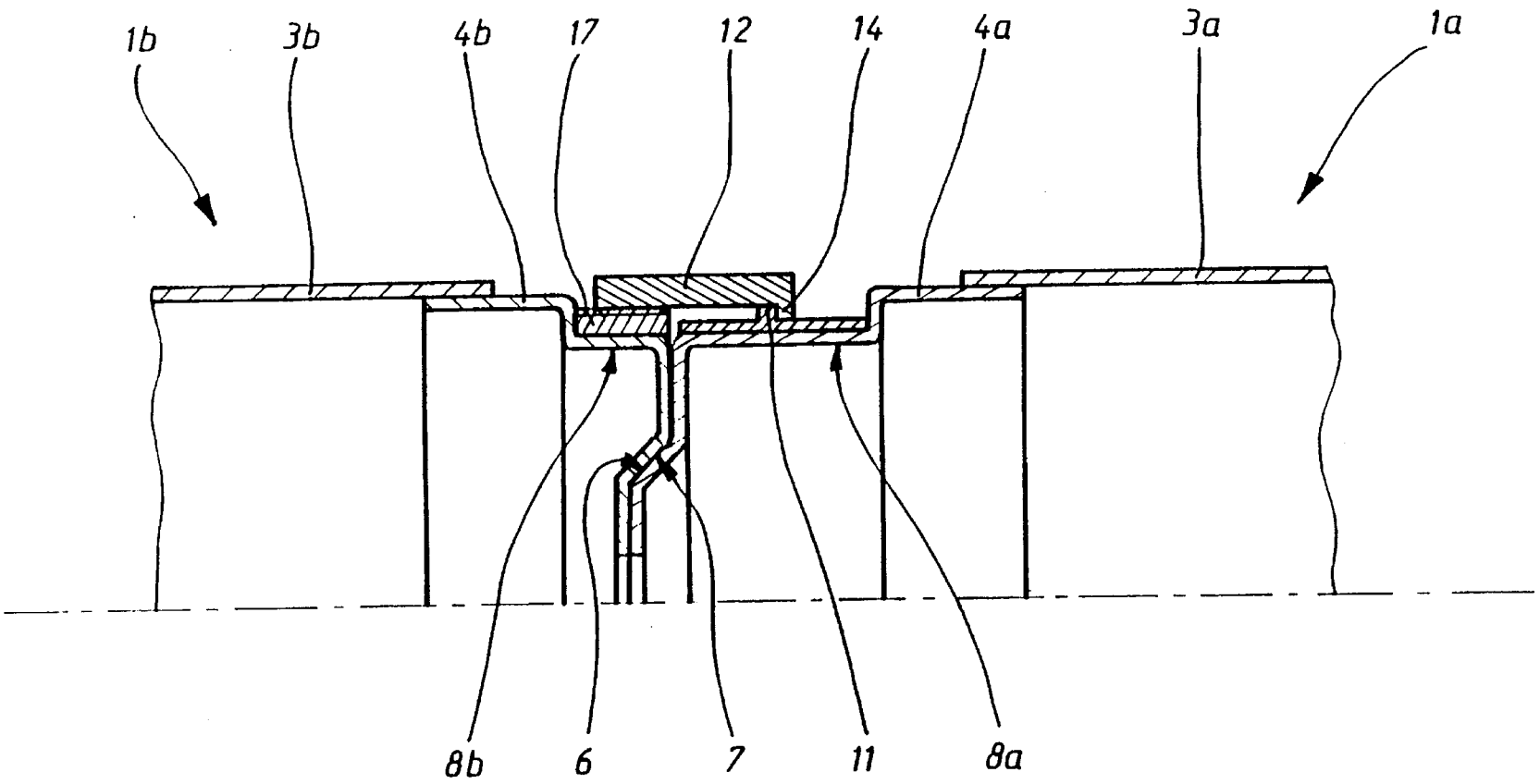
FIG. 2 shows the same two containers after integration.

FIG. 2 shows the two containers 1a and 1b assembled by the sleeve 12.

The containers have been placed in contact with one another at their front surfaces 2a, 2b. The recess 6 and the projection 7 then ensure that the containers are aligned.

The recess and the projection thus constitute means of ensuring satisfactory relative radial positioning of the two containers.

Once the containers are positioned with respect to one another, the sleeve 12 is slid on to the first neck 8a so as to place it in contact with the threaded ring 17.

Since the sleeve 12 can slide and rotate freely with respect to the inner sleeve 9, its tapping 16 can easily engage with the thread 18. It is therefore unnecessary to rotate one container to a particular angle with respect to the other in order to attach them together by means of the sleeve 12.

The sleeve 12 is screwed on the ring 17 until its shoulder 14 comes up against the collar 11 of the inner sleeve 9. In this way the collar 11 immobilises containers 1a and 1b in an axial direction when the sleeve covers the second neck 8b of the second container.

The dimensions of the sleeve, the inner sleeve and the ring will be determined in such a way as to make this axial immobilisation possible.

Thus when the containers are in contact at their front surfaces, it should be possible to bring the shoulder 14 up against the collar 11 after engaging the tapping in the sleeve with the thread of the ring.

For this it is sufficient that the sleeve 12, before reaching the end of its travel, can be moved longitudinally with respect to the first neck 8a through a distance less than or equal to the length of the second neck 8b on the second container 1b that it is to cover.

In practice the first neck 8a will be given a length twice that of the second neck 8b, and the sleeve 12 and its inner sleeve 9 will also be given a length twice that of the ring 17. The collar 11 will be positioned in such a way as to allow the sleeve to slide through half its length.

The constituent material of the sleeve, the inner sleeve and the ring fragments when the propellant charge is ignited under the effect of the gas pressure. In order to facilitate fragmentation zones of weakness may be provided, for example by local heating or by machining.

The two containers can be easily and quickly separated by unscrewing the sleeve 12 from the ring 17.

The use of plastics materials for making the sleeve, inner sleeve and ring makes it possible to design containers that are connected together in an extremely rigid manner.

Figure 3:
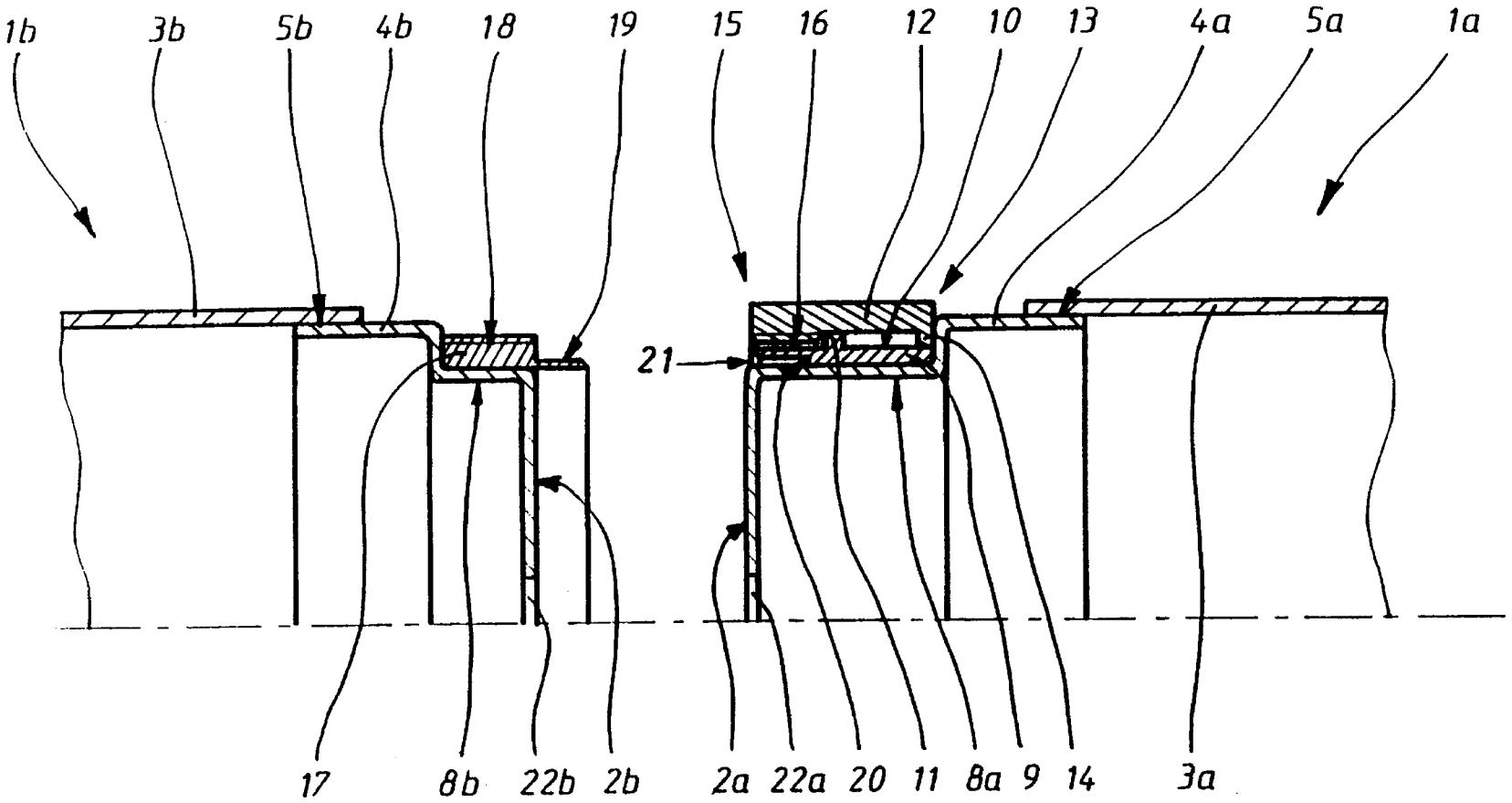
FIG. 3 shows a partial cross-section of two containers according to a second embodiment of the invention before they are integrated.
Figure 4:
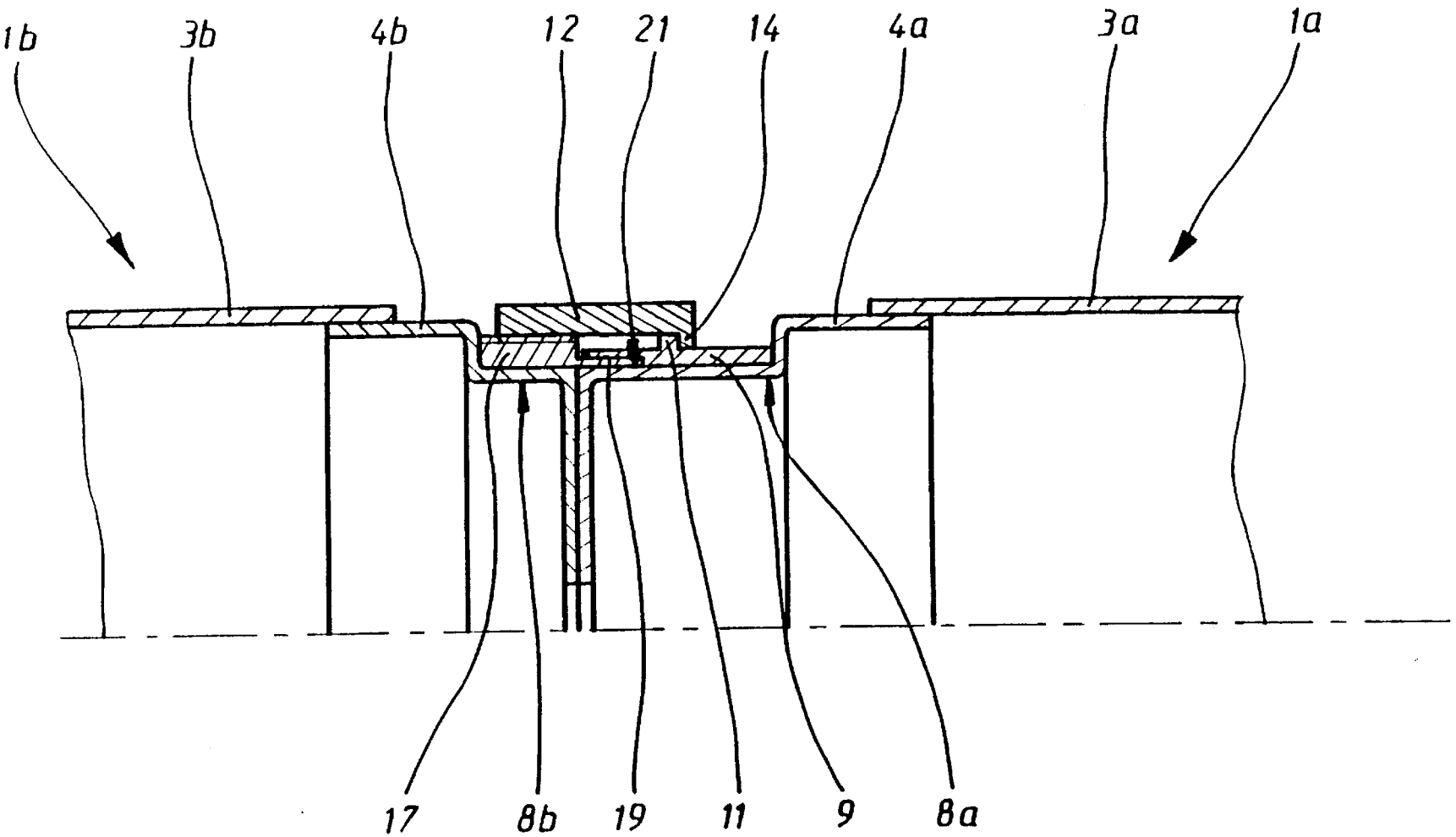
FIG. 4 shows the same two containers after integration.

FIGS. 3 and 4 show containers according to a second embodiment of the invention.

The front surfaces 2a and 2b of these containers are flat and hence do not comprise a recess or projection.

The threaded ring 17 carried by the container 1b comprises a tubular extension 19 the outside diameter of which is less than that of the ring.

The inner sleeve 9 comprises at its forward part a facing 20 which delimits, together with the first neck 8a, a circular slot 21.

The slot 21 is intended to accommodate the tubular extension 19, and therefore has a width equal to the thickness of the extension 19. Lead-in chamfers are machined so as to facilitate the insertion of the extension 19 in the slot 21.

FIG. 4 shows the containers of FIG. 3 after assembly.

The slot 21 and the tubular extension 19 constitute means of ensuring satisfactory relative radial positioning of the two containers. In this way they fulfil the function which in the previously described embodiment was fulfilled by the recess and the projection made on the front surfaces of the containers.

Such an embodiment makes it possible to simplify the manufacture of the containers because the front surfaces can be made flat. It also enables more rigid radial positioning which facilitates the screwing of the sleeve on the ring.

As a variant it is of course possible to provide a tubular extension integral with the inner sleeve 9 and intended to engage in a slot delimited by a facing on the ring 17.

Figure 5:
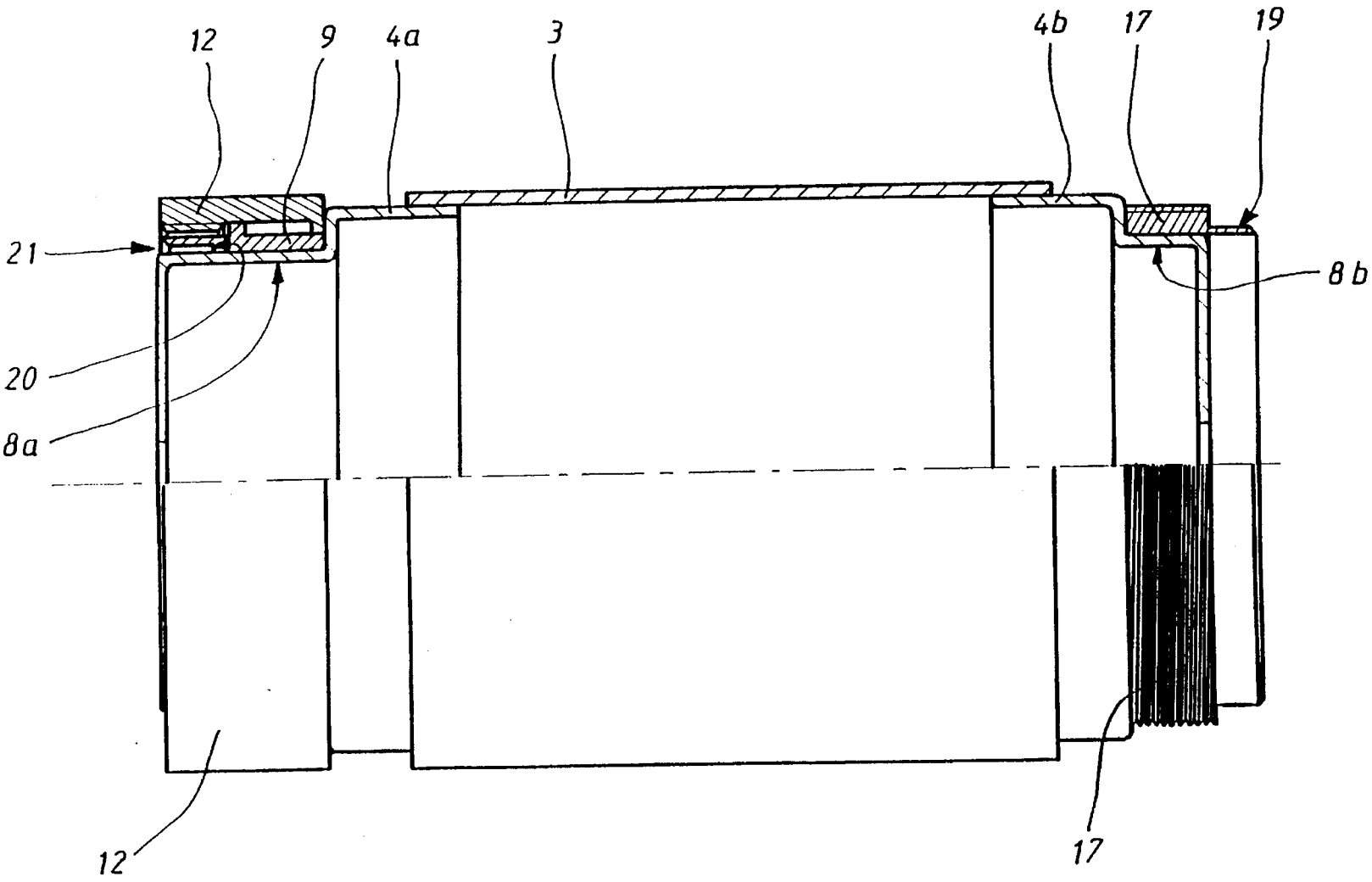
FIG. 5 shows a modular container according to the invention.

FIG. 5 shows a container of a modular type according to the invention. This container is made of a combustible material and is intended to be assembled with other containers which are completely identical with it in order to constitute a propellant charge for use in artillery.

The figure shows a half view/half cross-section, the upper part being sectioned axially and the lower part being shown as an outside view.

It consists of a combustible casing 3, closed at one end by a plug 4*a* which has a first neck 8*a* and at the other end by a plug 4*b* with a second neck 8*b*.

The first neck 8*a* carries an inner sleeve 9 and a sleeve 12, while the second neck 8*b* carries a ring 17.

The inner sleeve 9 has a facing 20 delimiting a circular slot 21, and the ring 17 comprises a tubular extension 19.

Clearly it would be possible to define a modular container the front surfaces of which comprised radial means of positioning consisting of a recess or a projection.

The combustible casing would then be closed at its ends by plugs 4*a*, 4*b* of the type shown in FIG. 1.

In all the embodiments of containers described previously, the cylindrical casing was closed by two combustible plugs having a neck.

As a variant, it will be possible to make at least one plug wholly integral with the casing as one and the same part. To do this the casing will be formed in an appropriate mould. In this way the delicate operation of attaching the plug to the casing by glueing is avoided.

It will be also possible to make plugs of plastics material by forming them as one and the same part with the ring or the inner sleeve.

As appropriate, the tubular extension will be integral with the plug and/or the circular slot will be made in the plug.

The geometry of these elements will be the same as that described previously: in particular both extension and slot will have their axis coincident with that of the container.

To define this variant it is sufficient to refer to the figures already described and to consider on these figures that plug and ring or plug and inner sleeve constitute one and the same part.

In order to facilitate fragmentation of the plugs made of a plastics material it is possible to make provision on the latter for zones of weakness, for example by local heating or by machining.

We claim:

1. A device for joining a first container to a second container, a first face of said first container being alignable with a second face of said second container along a longitudinal axis, said device comprising:

a first narrowed portion disposed adjacent said first face of said first container;

a second narrowed portion disposed adjacent said second face of said second container; and a sleeve disposed around said first narrowed portion, said sleeve being shaped to slide substantially parallel to said longitudinal axis from a first position to a second position, wherein said sleeve in said second position at least partially covers and threadedly engages a corresponding threaded portion of said second container.

2. The device of claim 1, wherein said sleeve includes a shoulder and said first narrowed portion includes an annular collar, and wherein said shoulder abuts said annular collar when said sleeve is in said second position to maintain engagement between said first container and said second container.

3. The device of claim 1, wherein said sleeve includes a shoulder and said first narrowed portion includes an inner sleeve connected to said first narrowed portion and disposed within said sleeve, said inner sleeve having an annular collar, and wherein said shoulder abuts said annular collar when said sleeve is in said second position to maintain engagement between said first container and said second container.

4. The device of claim 1, wherein said threaded portion of said second container is formed on said second narrowed portion.

5. The device of claim 1, wherein said second container includes a threaded ring connected to said second narrowed portion.

6. The device of claim 1, further comprising axial alignment means for aligning said first container with said second container along said longitudinal axis.

7. The device of claim 6, wherein said axial alignment means includes a tubular extension extending beyond one of said first face and said second face and a slot dimensioned to receive said tubular extension disposed in the other of said first face and said second face.

8. The device of claim 6, wherein said axial alignment means includes a protrusion extending from one of said first face and said second face and a recess dimensioned to receive said protrusion disposed in the other of said first face and said second face.

9. The device of claim 8, wherein said projection is frustum of a cone that extends from a center of one of said first face and said second face.

10. The device of claim 8, wherein said recess is shaped to receive a frustum of a cone and is disposed in a center of one of said first face and said second face.

11. A container joinable to other containers, said container having an outer surface, a first face and a second face aligned along a longitudinal axis, and a device for joining said container to said other containers, said device comprising:

a first narrowed portion disposed adjacent at least one of said first face of said first container and said second face of said second container;

a second narrowed portion disposed adjacent at least the other of said first face of said first container and said second face of said second container; and a sleeve disposed around said first narrowed portion, said sleeve being shaped to slide substantially parallel to said longitudinal axis from a first position to a second position, wherein said sleeve in said second position at least partially covers and threadedly engages a corresponding threaded portion of said second container.

12. The container of claim 11, wherein said sleeve includes a shoulder and said first narrowed portion includes an annular collar, and wherein said shoulder abuts said annular collar when said sleeve is in said second position to maintain engagement between said first container and said second container.

13. The container of claim 11, wherein said sleeve includes a shoulder and said first narrowed portion includes an inner sleeve connected to said first narrowed portion and disposed within said sleeve, said inner sleeve having an annular collar, and wherein said shoulder abuts said annular collar when said sleeve is in said second position to maintain engagement between said first container and said second container.

14. The container of claim 11, wherein said threaded portion of said second container is formed in said second narrowed portion.

15. The container of claim 11, wherein said second container includes a threaded ring connected to said second narrowed portion.

16. The container of claim 11, further comprising axial alignment means for aligning said first container with said second container along said longitudinal axis.

17. The container of claim 16, wherein said axial alignment means includes a tubular-extension extending beyond one of said first face and said second face and a slot dimensioned to receive said tubular extension disposed in the other of said first face and said second face.

18. The container of claim 16, wherein said axial alignment means includes a protrusion extending from one of said first face and said second face and a recess dimensioned to receive said protrusion disposed in the other of said first face and said second face.

19. The container of claim 18, wherein said projection is a frustum of a cone that extends from a center of one of said first face and said second face, and wherein said recess is shaped to receive a frustum of a cone and is disposed in a center of the other of said first face and said second face.

20. The container of claim 11, wherein said container includes a first narrowed portion disposed adjacent said first face and a second narrowed portion disposed adjacent said second face.

* * * * *